US009445701B2

(12) United States Patent
Gu

(10) Patent No.: US 9,445,701 B2
(45) Date of Patent: Sep. 20, 2016

(54) CLEANER AND VERTICAL CLEANER

(71) Applicants: JIANGSU MIDEA CLEANING APPLIANCES CO., LTD., Jiangsu (CN); MIDEA GROUP CO., LTD., Foshan (CN)

(72) Inventor: Youwei Gu, Jiangsu (CN)

(73) Assignee: Jiangsu Midea Cleaning Appliances Co., Ltd., Jiangsu (CN)

( * ) Notice: Subject to any disclaimer, the term of this patent is extended or adjusted under 35 U.S.C. 154(b) by 0 days.

(21) Appl. No.: 14/851,926

(22) Filed: Sep. 11, 2015

(65) Prior Publication Data

US 2016/0045091 A1 Feb. 18, 2016

Related U.S. Application Data

(63) Continuation of application No. PCT/CN2014/085413, filed on Aug. 28, 2014.

(30) Foreign Application Priority Data

Aug. 13, 2014 (CN) ..... 2014 1 0398128

(51) Int. Cl.
*A47L 9/04* (2006.01)
*A47L 5/30* (2006.01)
*A47L 9/22* (2006.01)

(52) U.S. Cl.
CPC ..... *A47L 9/0411* (2013.01); *A47L 5/30* (2013.01); *A47L 9/0477* (2013.01); *A47L 9/22* (2013.01)

(58) Field of Classification Search
CPC ..... A47L 9/0411; A47L 5/30; A47L 9/0477; A47L 9/22
See application file for complete search history.

(56) References Cited

U.S. PATENT DOCUMENTS 2,633,596 A * 4/1953 Turner ..... A47L 5/30 15/323
5,093,956 A * 3/1992 Saunders ..... A47L 5/32 15/327.1
7,114,216 B2 10/2006 Stephens et al.
7,422,615 B2 9/2008 Kim
7,708,791 B2 5/2010 Oh et al.
(Continued)

FOREIGN PATENT DOCUMENTS

CN 1947641 A 4/2007
CN 1954764 A 4/2007
(Continued)

OTHER PUBLICATIONS

PCTCN2014075272 English Translation of the International Search Report mailed Jan. 28, 2015; 2 pages.
(Continued)

*Primary Examiner* — Robert Scruggs
(74) *Attorney, Agent, or Firm* — Lathrop & Gage LLP

(57) ABSTRACT

A cleaner and a vertical cleaner are provided. The cleaner includes: a body having a connecting tube; a brush holder, with a rolling brush mounted therein; a motor cover rotatably mounted onto the brush holder around a first axis, defining an accommodating space therein, and having an opening, the connecting tube being configured to connect to the opening rotatably around a second axis different from the first axis; a motor disposed in the accommodating space for driving the rolling brush to rotate relative to the brush holder around a third axis parallel to the first axis.

13 Claims, 5 Drawing Sheets

(56) References Cited

U.S. PATENT DOCUMENTS

| | | | | |
|---|---|---|---|---|
| 7,749,294 | B2 | 7/2010 | Oh et al. | |
| 7,770,256 | B1 | 8/2010 | Fester | |
| 7,776,116 | B2 | 8/2010 | Oh et al. | |
| 7,780,752 | B2 | 8/2010 | Cha et al. | |
| 7,785,381 | B2 | 8/2010 | Oh et al. | |
| 7,803,205 | B2 | 9/2010 | Oh et al. | |
| 7,883,560 | B2 | 2/2011 | Ni | |
| 8,252,096 | B2 | 8/2012 | Horne | |
| 2002/0129461 | A1 | 9/2002 | Wegelin et al. | |
| 2004/0154126 | A1 | 8/2004 | Hansen et al. | |
| 2004/0231305 | A1 | 11/2004 | Oh | |
| 2005/0066469 | A1 | 3/2005 | Oh et al. | |
| 2005/0166560 | A1 | 8/2005 | Takemoto et al. | |
| 2006/0213161 | A1 | 9/2006 | Archambault et al. | |
| 2006/0254226 | A1 | 11/2006 | Jeon | |
| 2007/0144116 | A1 | 6/2007 | Hong et al. | |
| 2008/0190080 | A1 | 8/2008 | Oh et al. | |
| 2008/0264007 | A1 | 10/2008 | Oh et al. | |
| 2008/0295466 | A1 | 12/2008 | Cha et al. | |
| 2010/0132316 | A1 | 6/2010 | Ni | |
| 2010/0154367 | A1 | 6/2010 | Luo et al. | |
| 2010/0229328 | A1 | 9/2010 | Conrad | |
| 2011/0219574 | A1 | 9/2011 | Conrad | |
| 2011/0219581 | A1* | 9/2011 | Vines | A47L 5/28 15/410 |
| 2011/0314629 | A1* | 12/2011 | Conrad | A47L 5/24 15/323 |
| 2012/0284955 | A1 | 11/2012 | Han et al. | |
| 2013/0091660 | A1 | 4/2013 | Smith | |
| 2015/0289737 | A1 | 10/2015 | Riru et al. | |

FOREIGN PATENT DOCUMENTS

| | | | |
|---|---|---|---|
| CN | 101108105 | A | 1/2008 |
| CN | 101108106 | A | 1/2008 |
| CN | 101411603 | A | 4/2009 |
| CN | 101437596 | A | 5/2009 |
| CN | 201333002 | Y | 10/2009 |
| CN | 101658405 | A | 3/2010 |
| CN | 101721174 | A | 6/2010 |
| CN | 101756675 | A | 6/2010 |
| CN | 102334954 | | 2/2012 |
| CN | 202821202 | U | 3/2013 |
| CN | 203341657 | U | 12/2013 |
| CN | 203841620 | U | 9/2014 |
| JP | 2003180584 | A | 7/2003 |
| JP | 2010119623 | A | 3/2010 |
| WO | 2011112289 | A2 | 9/2011 |

OTHER PUBLICATIONS

PCTCN2014075274 English Translation of the International Search Report mailed Jan. 28, 2015; 2 pages.

PCTCN2014075112 English Translation of the International Search Report and Written Opinion mailed Jul. 16, 2014, 13 pages.

U.S. Appl. No. 14/852,953 Non-Final Office Action dated Nov. 2, 2015, 10 pages.

U.S. Appl. No. 14/852,920 Non Final Office Action dated Dec. 1, 2015, 14 pages.

U.S. Appl. No. 14/853,129 Non Final Office Action dated Dec. 2, 2015, 14 pages.

* cited by examiner

CLEANER AND VERTICAL CLEANER

CROSS-REFERENCE TO RELATED APPLICATIONS

This application is a continuation of International Patent Application No. PCT/CN2014/085413, filed Aug. 28, 2014, which claims the benefit of prior Chinese Application No. 201410398128.8 filed Aug. 13, 2014. The entire contents of the above-mentioned patent applications are incorporated by reference as part of the disclosure of this U.S. application.

FIELD

The present disclosure relates to the field of a cleaner, and more particularly to a cleaner and a vertical cleaner.

BACKGROUND

A conventional vertical cleaner generally uses two motors, one motor is disposed below a dust collecting container for collecting dust in the entire cleaner; the other motor is mounted on a floor brush for linking with a rolling brush to rotate. In this way, there are two switches, one switch is located on a handle for controlling the entire cleaner, and the other motor is located on the floor brush for controlling the rolling brush to operate, such that the cleaner is difficult to manufacture and high in cost and it is inconvenient for a consumer to use the cleaner. In addition, the handle of the conventional vertical cleaner cannot control an operation direction of the floor brush easily, thus affecting a use efficiency of the consumer.

SUMMARY

Embodiments of the present disclosure seek to solve at least one of the problems existing in the related art to at least some extent. Accordingly, the present disclosure provides a cleaner, which may control the dust collecting and the motion of a rolling brush simultaneously with one motor, which is simple and convenient.

The present disclosure further provides a vertical cleaner.

A cleaner according to embodiments of a first aspect of the present disclosure includes a body having a connecting tube; a brush holder, with a rolling brush mounted therein; a motor cover rotatably mounted onto the brush holder around a first axis, defining an accommodating space therein, and having an opening, the connecting tube being configured to connect to the opening rotatably around a second axis different from the first axis; a motor disposed in the accommodating space for driving the rolling brush to rotate relative to the brush holder.

With the cleaner according to embodiments of the present disclosure, the dust collecting and the motion of the rolling brush may be controlled simultaneously with one motor, such that the control difficulty may be reduced, and the cleaner may be easy to manufacture, low in cost, and convenient to use. In addition, during the dust collecting, since the motor cover is mounted on the brush holder rotatably around the first axis and the connecting tube is connected to the opening rotatably around the second axis, the body of the cleaner may have degrees of freedom in two directions, such that it is possible to simply and conveniently control the running direction of the brush holder by driving the body such as the handle in two directions.

In an embodiment, the first axis is perpendicular to the second axis, such that the cleaner is easy to manufacture, aesthetic in appearance, and convenient for a user to use.

In an embodiment, the brush holder has a mounting portion at a side thereof away from the rolling brush, and a boss is provided at each of two axial ends of the motor cover and rotatably mounted in the mounting portion, such that it is possible to realize the rotation of the motor cover relative to the brush holder.

Alternatively, the mounting portion is configured as a first semicircular groove, and the boss is configured as a cylindrical boss.

In an embodiment, the cleaner further includes: a fixing member defining two ends each having a second semicircular groove, the second semicircular groove being matched with the first semicircular groove to define a circular accommodating hole for accommodating the boss.

In an embodiment, the fixing member surrounds a part of the motor cover and comprises: a connecting plate having a length extended in an axial direction of a shaft of the motor; two fixing plates connected to two ends of the connecting plate respectively, the second semicircular grooves being formed at free ends of the two fixing plates respectively.

In an embodiment, a snap groove is formed in an upper end of the fixing member, and a snap tongue matched with the snap groove is provided on the body or the connecting tube. Therefore, when the cleaner is in an idle state, the snap tongue on the body or the connecting tube may be matched with the snap groove so as to position the body in a vertical position, thus saving the occupying space and facilitating the taking when the cleaner is used again.

In an embodiment, a rotation angle of the motor cover around the first axis relative to the brush holder ranges from 0 to 90 degrees.

In an embodiment, the shaft of the motor is extended out from a side of the motor cover, and drives the rolling brush to rotate via a belt.

In an embodiment, the brush holder defines a chamber therein, the rolling brush and the belt are located in the chamber, and the shaft of the motor is extended into the chamber.

In an embodiment, an opening tube is extended outwardly from the opening of the motor cover, and a lower end of the connecting tube is rotatably connected within the opening tube.

In an embodiment, the cleaner further includes: a collar fitted over the opening tube, and having a protrusion which is protruded inwardly on an inner surface thereof, the protrusion being passed through the opening tube and matched with an annular groove in an outer surface of the connecting tube.

In this way, by the matching of the protrusion of the collar and the annular groove of the connecting tube, the connecting tube may rotate relative to the opening tube and the collar without disengaging therefrom, thus enhancing the reliability of the connection between the connecting tube and the opening tube. Alternatively, the protrusion is formed by stamping a part of the collar inwardly.

In an embodiment, the matching between the protrusion and the annular groove is configured in such a way that the connecting tube is rotated through 0 to 180 degrees relative to the opening tube.

A vertical cleaner according to embodiments of a second aspect of the present disclosure includes a body having a connecting tube at a lower end thereof; a brush holder located at a lower portion of the body, a rolling brush being mounted at a front end of the brush holder; a motor cover rotatably mounted onto an end of the brush holder away from the rolling brush, and defining an accommodating space therein, an opening tube communicated with the accommodating space being provided on the motor cover, the connecting tube being rotatably connected to the opening tube; a motor disposed in the accommodating space, a shaft of the motor being extended out from a side of the motor cover and driving the rolling brush to rotate relative to the brush holder via a belt.

In an embodiment, the connecting tube is rotated through 0 to 180 degrees relative to the opening tube.

With the cleaner according to embodiments of the present disclosure, by the rotation operation in two directions, it is possible to realize convenient and fast cleaning, and to control the running direction of the cleaner easily. In addition, the dust collecting and the motion of the rolling brush may be controlled simultaneously with one motor, and the dust collecting may be realized by controlling only one switch, thus reducing the control difficulty compared to a conventional cleaner with two switches. Therefore, the cleaner may be easy to manufacture, low in cost, and convenient to use.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

REFERENCE NUMERALS

Figure 1:
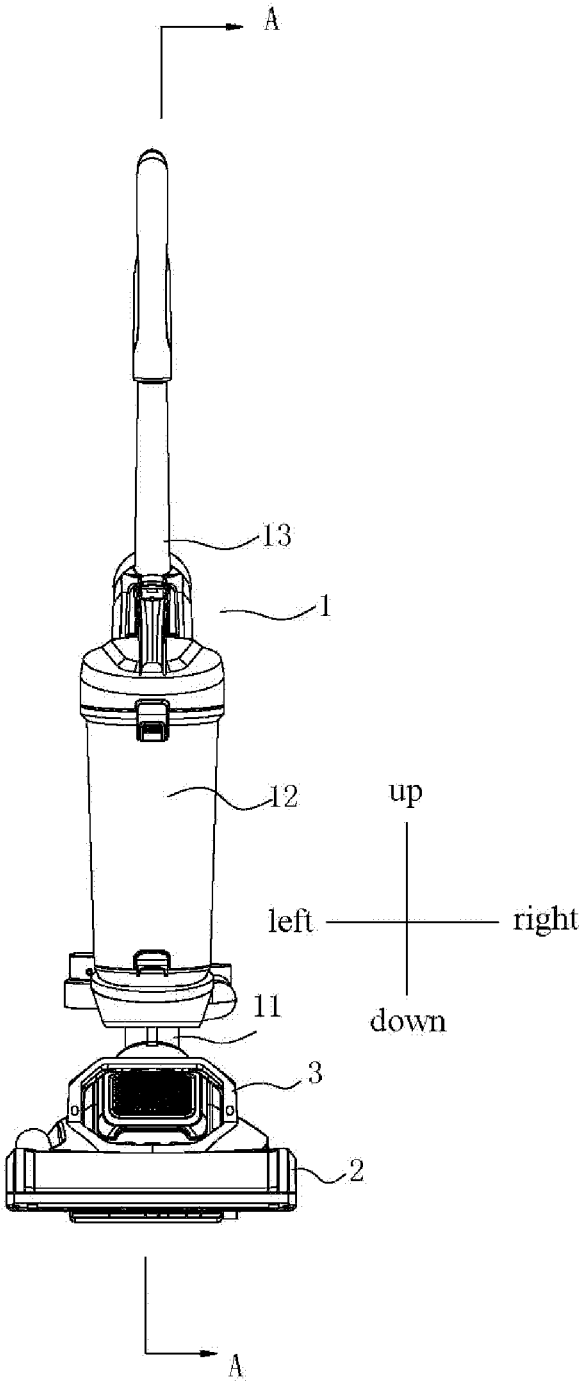
FIG. 1 is a schematic view of a cleaner according to an embodiment of the present disclosure.

1 body;
11 connecting tube;
111 annular groove;
12 dust cup;
13 handle;
2 brush holder;
20 chamber;
21 rolling brush;
211 rolling brush pivot;
23 mounting portion;
23 operation opening;
3 motor cover;
30 accommodating space;
31 opening;
32 boss;
4 motor;
41 shaft of motor;
5 fixing member;
50 second semicircular groove;
51 connecting plate;
52 fixing plate;
53 snap groove;
54 circular accommodating hole;
6 opening tube;
7 collar;
71 protrusion;
8 belt.

DETAILED DESCRIPTION

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the specification, unless specified or limited otherwise, relative terms such as "central", "longitudinal", "up", "below", "front", "rear", "left", "right", "vertical", "horizontal", "top", "bottom", "inner", "outer", "axial", and "radial" should be construed to refer to the orientation as then described or as shown in the drawings under discussion. These relative terms are for convenience of description and do not require that the present disclosure be constructed or operated in a particular orientation. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the description of the present disclosure, it should be understood that, unless specified or limited otherwise, the terms "mounted," "connected," and "coupled" and variations thereof are used broadly and encompass such as mechanical or electrical mountings, connections and couplings, also can be inner mountings, connections and couplings of two components, and further can be direct and indirect mountings, connections, and couplings, which can be understood by those skilled in the art according to the detail embodiment of the present disclosure.

The cleaner according to embodiments of the present disclosure will be described below with reference to FIGS. 1-8. In the description of the specification and drawings, the cleaner according to the present disclosure will be illustrated by taking a vertical cleaner as an example. However, it would be appreciated by those skilled in the art that other types of cleaners may also operate similarly.

Figure 2:
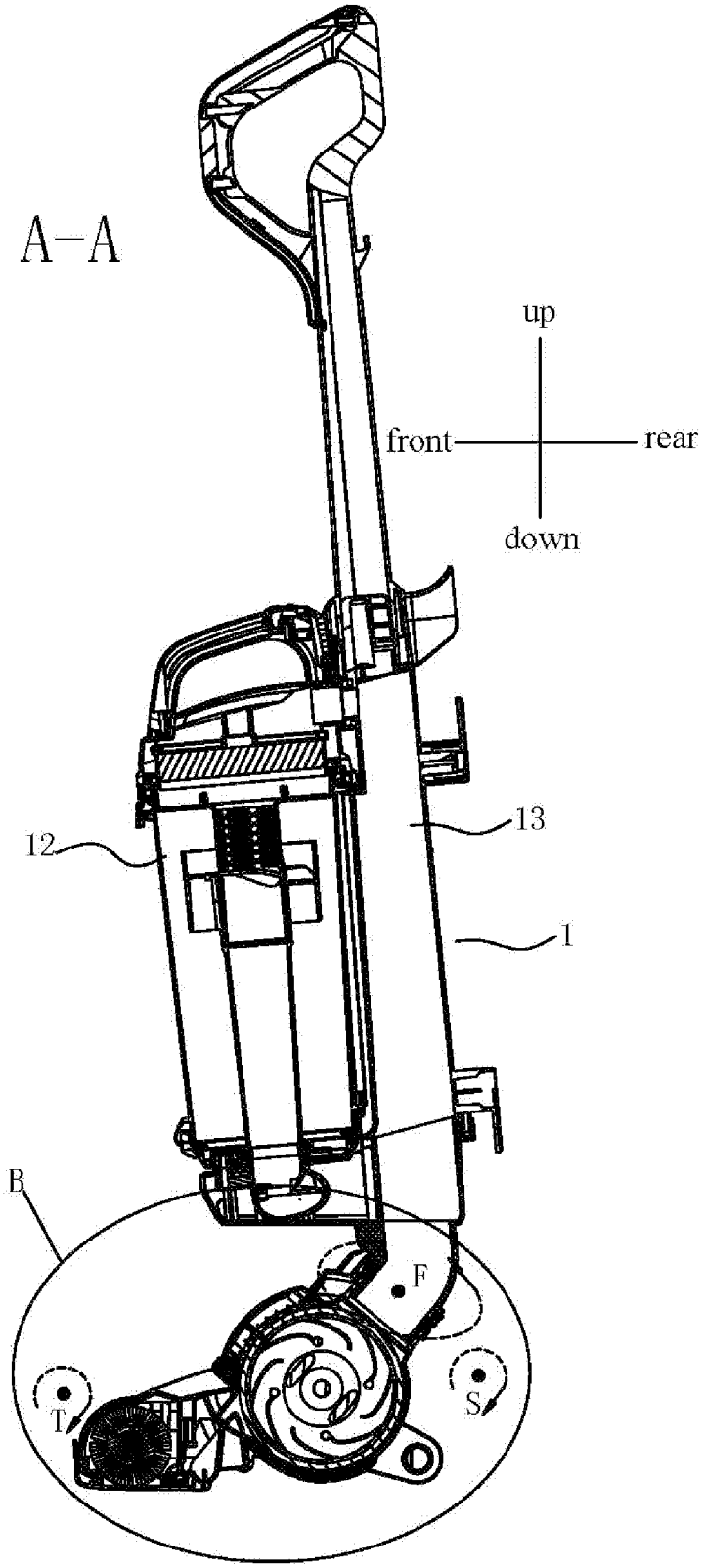
FIG. 2 is a sectional view taken along line A-A of FIG. 1.

The cleaner according to embodiments of the present disclosure includes a body 1, a brush holder 2, a motor cover 3 and a motor 4. As shown in FIGS. 1-2, the body 1 has a connecting tube 11. Certainly, it would be understood by those skilled in the art that the body 1 further has other components, such as a dust cup 12, a handle 13, etc. The particular structure of the body 1 will not be described in detail herein.

Figure 5:
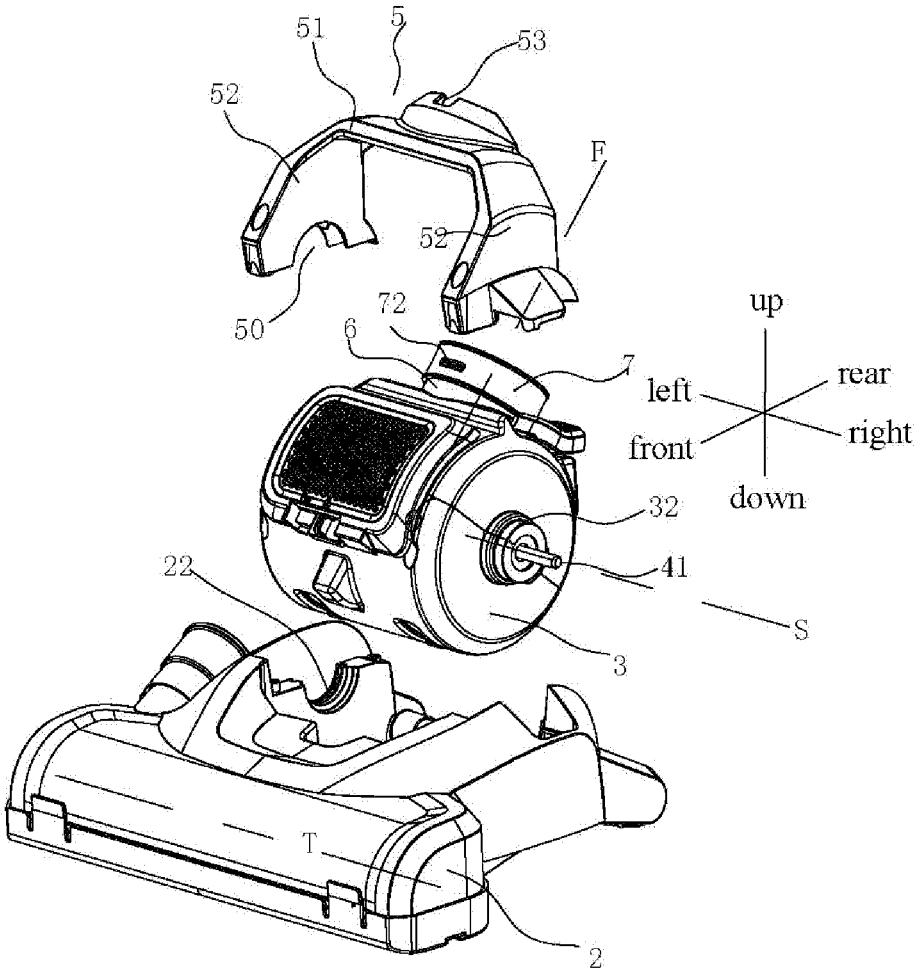
FIG. 5 is a schematic exploded view showing a motor cover, a brush holder and a fixing member of a cleaner according to an embodiment of the present disclosure.

A rolling brush 21 is mounted in the brush holder 2. As shown in FIG. 2 and FIG. 5, the motor cover 3 is rotatably mounted onto the brush holder 2 around a first axis S, defines an accommodating space 30 therein, and has an opening 31, and the connecting tube 11 is configured to connect to the opening 31 rotatably around a second axis F different from the first axis S. The motor 4 is disposed in the accommodating space 30 for driving the rolling brush 21 to rotate relative to the brush holder 2 around a third axis T parallel to the first axis S. Alternatively, the first axis S is perpendicular to the second axis F. In one embodiment, as shown in FIGS. 1-2, the first axis S is extended in a left-right direction of the cleaner, and the second axis F is extended in an up-down direction of the cleaner. In the example shown in FIGS. 7-8, a shaft 41 of the motor 4 is extended out from a side of the motor cover 3, and drives the rolling brush 21 to rotate via a belt 8.

Figure 3:
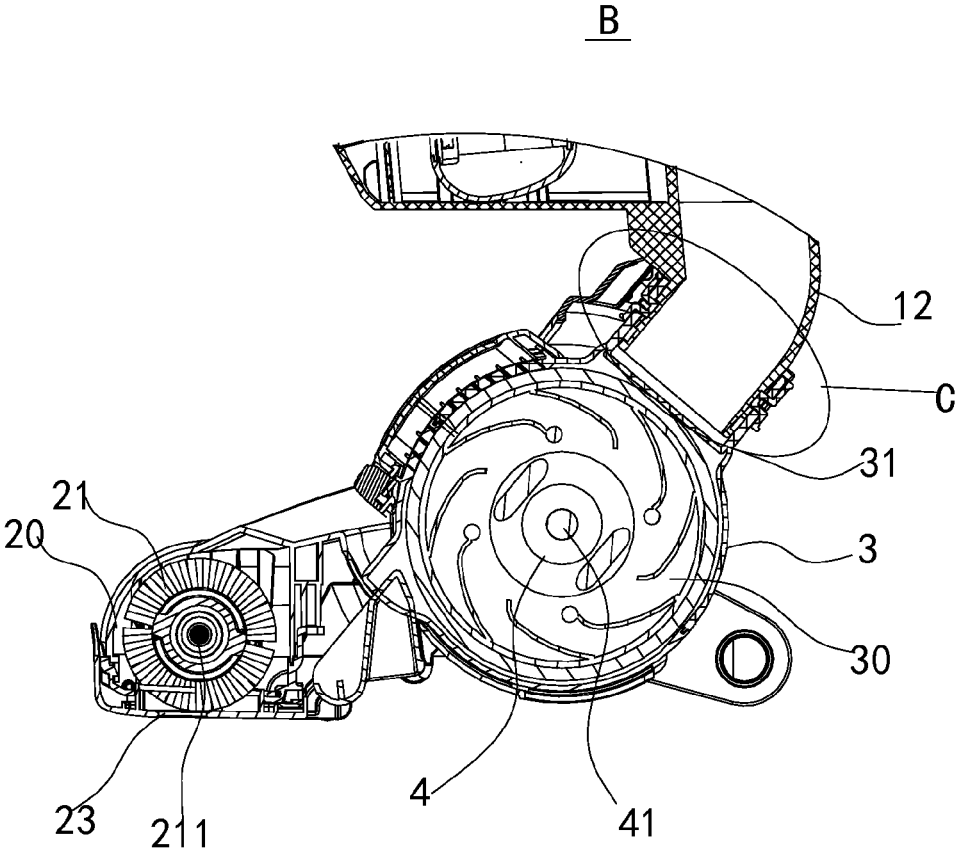
FIG. 3 is an enlarged view of a portion B of FIG. 2.
Figure 8:
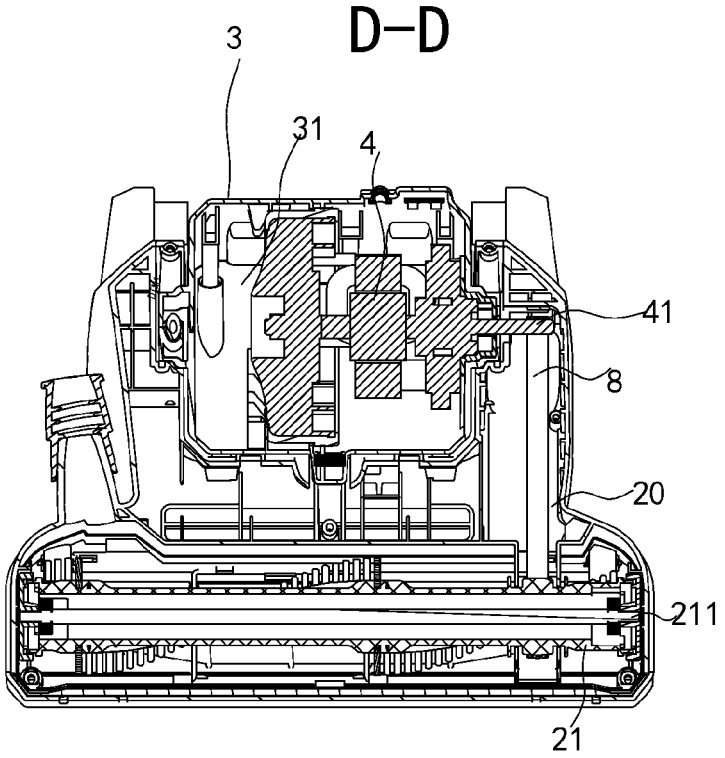
FIG. 8 is a sectional view taken along line D-D of FIG. 7.

Specifically, the brush holder 2 defines a chamber 20 therein, and the rolling brush 21 and the belt 8 are located in the chamber 20. As shown in FIG. 3 and FIG. 8, two ends of a rolling brush pivot 211 of the rolling brush 21 are mounted in the chamber 20, the rolling brush 21 is rotated relative to the rolling brush pivot 211, and an operation opening 23 is formed in a lower end of the brush holder 2. The shaft 41 of the motor 4 is extended into the chamber 20 to drive the belt 8 to rotate, so as to drive the rolling brush 21 to rotate relative to the rolling brush pivot 211, such that it is possible to realize the driving of the rolling brush 21 by the motor 4. In this way, the motor 4 starts to operate so as to drive the rolling brush 21 to rotate, the rolling brush 21 cleans dust or other debris on a work bench such as a floor and sucks the dust or other debris in the chamber 20 from the operation opening 23, the chamber 20 is communicated with the accommodating space 30 of the motor cover 3, and the accommodating space 30 is communicated with the connecting tube 11 and the dust cup 12 of the body 1, i.e. the dust or other debris introduced from the chamber 20 finally enters into the dust cup 12.

With the cleaner according to embodiments of the present disclosure, the dust collecting and the motion of the rolling brush may be controlled simultaneously with one motor, such that the control difficulty may be reduced, and the cleaner may be easy to manufacture, low in cost, and convenient to use. In addition, during the dust collecting, since the motor cover 3 is mounted on the brush holder 2 rotatably around the first axis and the connecting tube 11 is connected to the opening 31 rotatably around the second axis F, the body of the cleaner may have degrees of freedom in two directions, such that it is possible to simply and conveniently control the running direction of the brush holder 2 by driving the body such as the handle in two directions.

Figure 6:
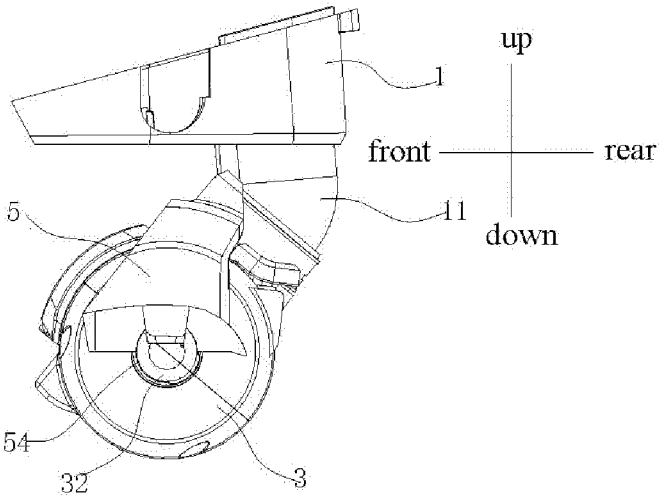
FIG. 6 is a side view of an assembly of a body and a motor cover of the cleaner shown in FIG. 1.
Figure 7:
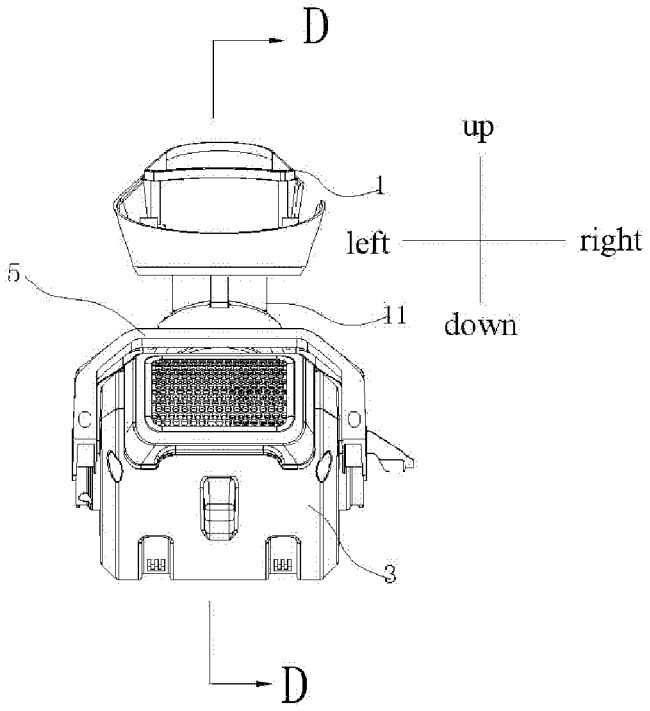
FIG. 7 is a front view of the assembly of the body and the motor cover shown in FIG. 6.

In one embodiment, as shown in FIGS. 5-6, the brush holder 2 has a mounting portion 22 at a side thereof away from the rolling brush 21, and a boss 32 is provided at each of two axial ends of the motor cover 3 and rotatably mounted in the mounting portion 22, such that it is possible to realize the rotation of the motor cover 3 relative to the brush holder 2. In an alternative embodiment, the mounting portion 22 is configured as a first semicircular groove, and the boss 32 is configured as a cylindrical boss, such that the cylindrical boss 32 may be rotatably supported in the first semicircular groove 22. Preferably, a central axis of the cylindrical boss 32 coincides with the first axis S.

In a further embodiment, the cleaner further includes a fixing member 5 defining two ends each having a second semicircular groove 50, the second semicircular groove 50 being matched with the first semicircular groove to define a circular accommodating hole 54 for accommodating the boss 32, as shown in FIG. 6. Specifically, the fixing member 5 is disposed across the motor cover 3, for example, the fixing member 5 surrounds a part of the motor cover 3. In the example shown in FIG. 5, the fixing member 5 includes a connecting plate 51 and two fixing plates 52, the connecting plate 51 has a length extended in an axial direction of a shaft 41 of the motor 4, two fixing plates 52 are connected to two ends (i.e. left and right ends in FIG. 5) of the connecting plate 51 respectively, and the second semicircular grooves 50 are formed at free ends (i.e. lower ends in FIG. 5) of the two fixing plates 52 respectively.

As shown in FIG. 5, in some embodiments, a snap groove 53 is formed in an upper end of the fixing member 5, and a snap tongue (not shown) matched with the snap groove 53 is provided on the body 1 or the connecting tube 11. Therefore, when the cleaner is in an idle state, the snap tongue on the body 1 or the connecting tube 11 may be matched with the snap groove 53 so as to position the body 1 in a vertical position, thus saving the occupying space and facilitating the taking when the cleaner is used again. In some embodiments, a rotation angle of the motor cover 3 relative to the brush holder 2 may be designed to be 0 to 70 degrees. For example, a maximum angle between a central line of the body 1 when the body 1 is vertical and the central line of the body 1 when the body 1 lies flat is 70 degrees.

Figure 4:
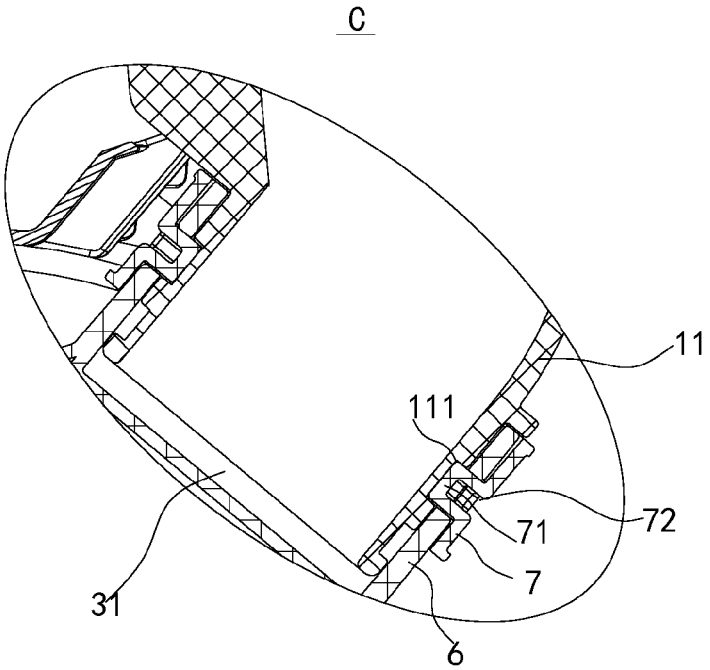
FIG. 4 is an enlarged view of a portion C of FIG. 3.

As shown in FIGS. 3-4, in other embodiments, an opening tube 6 is extended outwardly from the opening 31 of the motor cover 3, and a lower end of the connecting tube 11 is rotatably connected within the opening tube 6. Alternatively, the opening 31 is a circular opening, such that the opening tube 6 is a cylindrical tube. In this case, the second axis is a central line of the opening tube 6, and the first axis is an axis where the shaft 41 of the motor 4 is located, i.e. the central line of the opening tube 6 is substantially perpendicular to the axis where the shaft 41 of the motor 4 is located, such that the cleaner is easy to manufacture, aesthetic in appearance, and convenient for a user to use.

Further, as shown in FIGS. 4-5, the cleaner further includes a collar 7 fitted over the opening tube 6, and having a protrusion 71 which is protruded inwardly on an inner surface thereof, and the protrusion 71 is passed through the opening tube 6 and matched with an annular groove 111 in an outer surface of the connecting tube 11. In this way, by the matching of the protrusion 71 of the collar 7 and the annular groove 111 of the connecting tube 11, the connecting tube 11 may rotate relative to the opening tube 6 and the collar 7 without disengaging therefrom, thus enhancing the reliability of the connection between the connecting tube 11 and the opening tube 6. In an alternative example, the protrusion 71 is formed by stamping a part of the collar 7 inwardly, i.e. a depression 72 corresponding to the protrusion 71 is formed in an outer surface of the collar 7, as shown in FIGS. 4-5.

In some examples, the matching between the protrusion 71 and the annular groove 111 is configured in such a way that the connecting tube 11 is rotated through 0 to 150 degrees relative to the opening tube 6, such that it is convenient for the user to use the cleaner.

The particular operation process of the cleaner according to an embodiment of the present disclosure will be described below with reference to FIGS. 1-8, in which the vertical cleaner is taken as an example for explanation.

During the operation, as shown in FIG. 2, the motor 4 is started, and the shaft 41 of the motor 4 drives the rolling brush 21 to roll via the belt 8. Dust and other debris as well as air are sucked in the chamber 20, and then are passed through the motor cover 3, enter into the dust cup 12 through the opening tube 6 and the connecting tube 11, and are separated by the dust cup 12, such that the dust and other debris remain in the dust cup 12 and air is vented.

In this process, since the connecting tube 11 of the body 1 is rotatable relative to the motor cover 3 around the up-down direction and the motor cover 3 is rotatable relative to the brush holder 2 around a horizontal direction, such that during the dust collecting, the user pushes the handle to rotate in two directions.

With the cleaner according to embodiments of the present disclosure, by the rotation operation in two directions, it is possible to realize convenient and fast cleaning, and to control the running direction of the cleaner easily. In addition, the dust collecting and the motion of the rolling brush may be controlled simultaneously with one motor, and the dust collecting may be realized by controlling only one switch, thus reducing the control difficulty compared to a conventional cleaner with two switches. Therefore, the cleaner may be easy to manufacture, low in cost, and convenient to use.

Other components such as the handle, the dust cup and control structures of the cleaner according to embodiments of the present disclosure and the operation thereof are well known to those skilled in the art, which will not be described in detail herein.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A cleaner, comprising:

a body having a connecting tube;

a brush holder, with a rolling brush mounted therein;

a motor cover rotatably mounted onto the brush holder around a first axis, defining an accommodating space therein, and having an opening, the connecting tube being configured to connect to the opening rotatably around a second axis different from the first axis and exposed to air, wherein an opening tube is extended outwardly from the opening of the motor cover, and a lower end of the connecting tube is rotatably connected within the opening tube;

a collar removably fitted over the opening tube, and having a protrusion which is protruded inwardly on an inner surface thereof, the protrusion being passed through the opening tube and matched with an annular groove in an outer surface of the connecting tube, a depression corresponding to the protrusion being formed in an outer surface of the collar;

a motor disposed in the accommodating space and configured to drive the rolling brush to rotate relative to the brush holder around a third axis parallel to the first axis.

2. The cleaner according to claim 1, wherein the first axis is perpendicular to the second axis.

3. The cleaner according to claim 1, wherein the brush holder has a mounting portion at a side thereof away from the rolling brush, and a boss is provided at each of two axial ends of the motor cover and rotatably mounted in the mounting portion.

4. The cleaner according to claim 3, wherein the mounting portion is configured as a first semicircular groove, and the boss is configured as a cylindrical boss.

5. The cleaner according to claim 4, further comprising:

a fixing member defining two ends each having a second semicircular groove, the second semicircular groove being matched with the first semicircular groove to define a circular accommodating hole for accommodating the boss.

6. The cleaner according to claim 5, wherein the fixing member surrounds a part of the motor cover and comprises:

a connecting plate having a length extended in an axial direction of a shaft of the motor;

two fixing plates connected to two ends of the connecting plate respectively, the second semicircular grooves being formed at free ends of the two fixing plates respectively.

7. The cleaner according to claim 5, wherein a snap groove is formed in an upper end of the fixing member, and a snap tongue matched with the snap groove is provided on the body or the connecting tube.

8. The cleaner according to claim 1, wherein a rotation angle of the motor cover around the first axis relative to the brush holder ranges from 0 to 90 degrees.

9. The cleaner according to claim 1, wherein the shaft of the motor is extended out from a side of the motor cover, and drives the rolling brush to rotate via a belt.

10. The cleaner according to claim 9, wherein the brush holder defines a chamber therein, the rolling brush and the belt are located in the chamber, and the shaft of the motor is extended into the chamber.

11. The cleaner according to claim 1, wherein the matching between the protrusion and the annular groove is configured in such a way that the connecting tube is rotated through 0 to 180 degrees relative to the opening tube.

12. A vertical cleaner, comprising:

a body having a connecting tube at a lower end thereof, the connecting tube being exposed to air;

a brush holder located at a lower portion of the body, a rolling brush being mounted at a front end of the brush holder;

a motor cover rotatably mounted onto an end of the brush holder away from the rolling brush, and defining an accommodating space therein, an opening tube communicated with the accommodating space being provided on the motor cover, a lower end of the connecting tube being rotatably connected within the opening tube;

a collar removably fitted over the opening tube, and having a protrusion which is protruded inwardly on an inner surface thereof, the protrusion being passed through the opening tube and matched with an annular groove in an outer surface of the connecting tube, a depression corresponding to the protrusion being formed in an outer surface of the collar;

a motor disposed in the accommodating space, a shaft of the motor being extended out from a side of the motor cover and driving the rolling brush to rotate relative to the brush holder via a belt.

13. The vertical cleaner according to claim 12, wherein the connecting tube is rotated through 0 to 180 degrees relative to the opening tube.

* * * * *